US006065402A

United States Patent [19]

Feller et al.

[11] Patent Number: 6,065,402

[45] Date of Patent: May 23, 2000

[54] INKING DEVICE FOR A PRINTING MACHINE

[75] Inventors: Bernhard Feller, Friedberg; Wolfram Fischer, Neusäss; Xaver Bachmeir, Affing-Haunswies, all of Germany

[73] Assignee: MAN Roland Druckmaschinen AG, Offenbach am Main, Germany

[21] Appl. No.: 09/067,302

[22] Filed: Apr. 27, 1998

[30] Foreign Application Priority Data

Apr. 25, 1997 [DE] Germany ..... 197 17 524

[51] Int. Cl.[7] ..... B41F 31/00; B41F 3/36; B41F 23/04

[52] U.S. Cl. ..... 101/350.5; 101/350.6; 101/161; 101/487

[58] Field of Search ..... 101/154, 161, 101/167, 169, 350.5, 350.6, 487

[56] References Cited

U.S. PATENT DOCUMENTS

| | | | |
|---|---|---|---|
| 3,877,369 | 4/1975 | D'Amato | 101/157 |
| 3,956,986 | 5/1976 | Wirz et al. | 101/350 |
| 4,119,836 | 10/1978 | Motokawa | 219/528 |
| 4,156,524 | 5/1979 | Bar-on et al. | 271/174 |
| 5,046,420 | 9/1991 | Sondergeld et al. . | |
| 5,189,960 | 3/1993 | Valentini et al. | 101/487 |
| 5,218,905 | 6/1993 | Bolte et al. . | |
| 5,237,375 | 8/1993 | Michlin et al. | 355/299 |
| 5,429,051 | 7/1995 | Laubscher | 101/417 |
| 5,671,678 | 9/1997 | Bolte et al. . | |
| 5,694,848 | 12/1997 | Palmatier | 101/219 |

FOREIGN PATENT DOCUMENTS

| | | |
|---|---|---|
| 542 190 | 5/1993 | European Pat. Off. . |
| 551 432 | 6/1932 | Germany . |
| 573 870 | 4/1933 | Germany . |
| 41 08 883 | 9/1992 | Germany . |
| 295 10 929 U | 2/1996 | Germany . |
| 196 04 526 | 8/1996 | Germany . |
| 5-338120 | 12/1993 | Japan . |

*Primary Examiner*—Kimberly Asher
*Attorney, Agent, or Firm*—Cohen, Pontani, Lieberman & Pavane

[57] ABSTRACT

An inking device in a printing machine with an ink body filled with printing ink and with a blade. The blade can also be a chamber blade, for example. For temperature moderation, an insulation plate or a heat dissipation plate, by which the temperature of the blade can be adjusted, is arranged on the blade. The heat created by friction between the upper edge of the blade and the surface of the cup roller does not penetrate into the ink duct due to the insulation plate and the heat dissipation plate, so that heating of the printing ink is avoided.

17 Claims, 3 Drawing Sheets

INKING DEVICE FOR A PRINTING MACHINE

BACKGROUND OF THE INVENTION

1. Field of the Invention

The invention relates to an inking device.

2. Discussion of the Prior Art

German reference DE 295 10 929 U1 discloses a printing group with a short inker that has an inking device of this type in a rotary printing machine. The inking device contains a blade device which supplies printing ink to a structured ink transfer roller.

Other blades that serve to remove excess printing ink from the surface of a roller with depressions, especially cups, are also known, e.g., chamber blades. In inking devices of this type, frictional heat is produced by friction between the blade and the roller on which the blade rests. This heat partially dissipates into the structured roller, e.g., a cup roller, but in part dissipates into the printing ink itself. A smaller portion dissipates via the blade into the blade holder and from there into the printing machine frame.

It has been found that the heat flow in the blade is hindered primarily by the small cross-sectional area of the blade, relative to the main direction of the heat flow. The result is that the blade tip becomes highly heated. Therefore, the printing ink in contact with the blade, as well as the cup roller, heats up in the region of the outer circumference of the roller.

In all printing processes, particularly flat-bed printing and, especially, water-free flat-bed printing, a constant temperature is required to ensure consistent and adequate print quality.

For this reason, one or more of the rollers or cylinders in the inking device may be cooled. At times, the form cylinder is cooled as well. The disadvantage of such cooling is that when a cooling liquid is supplied to a rotating body, i.e., a roller or cylinder, rotations must be carried out. Furthermore, other cooling methods, such as blowing cool air onto the mantle surfaces of the rollers or cylinders, are relatively ineffective. In particular, the quantity of heat that develops in the blade tip is already distributed to a large mass, so that the temperature difference between the cooling medium and the mantle surface of the rollers and cylinders is much lower than the temperature difference between the blade tip and the media surrounding the blade tip. When the temperature difference is low, the cooling expense is high, i.e., a great deal of coolant must be supplied for a relatively long period to achieve a relatively small decrease in temperature.

SUMMARY OF THE INVENTION

Accordingly, it is an object of the present invention is to provide an inking device in which excessive heating of the printing ink is prevented.

Pursuant to this object, and others which will become apparent hereafter, one aspect of the present invention resides in an inking device having an ink reservoir, such as an ink duct filled or an ink chamber, filled with printing ink and a blade for wiping the ink from a structured ink transfer roller. The blade is thermally insulated from the printing ink in the ink duct, so that only a small portion of the frictional heat can flow via the blade into the printing ink. In addition, the blade is cooled on its side facing away from the ink duct. The heat is dissipated via the housing, and forced cooling via cold air or a liquid is also possible.

The invention provides the advantage that the heat created by friction between the blade device and the structured roller is extracted in the very vicinity of its creation. This means that cooling occurs with large temperature differences, so that only a low coolant throughput is required. The invention is suitable for open ink ducts as well as for closed ink chambers (chamber blades). The invention is especially suitable for short inking devices (anilox inking devices).

It is especially advantageous for the ink transfer roller to also be cooled with cold air or a cold gas or, as needed, heated. For this purpose, the ink transfer roller can be hollow. The ink transfer roller can also be advantageously embodied with cooling ribs, particularly in connection with spokes on the interior wall. The cold air or a gas, e.g., expanding pressurized air, is blown into and out of the ink transfer roller through entrance and exit openings in the end faces of the roller. It is also possible for rollers of the inking device, e.g., the ink application roller, to be cooled in this manner. The form cylinder or the rubber-blanket cylinder of the printing machine can be cooled as well.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
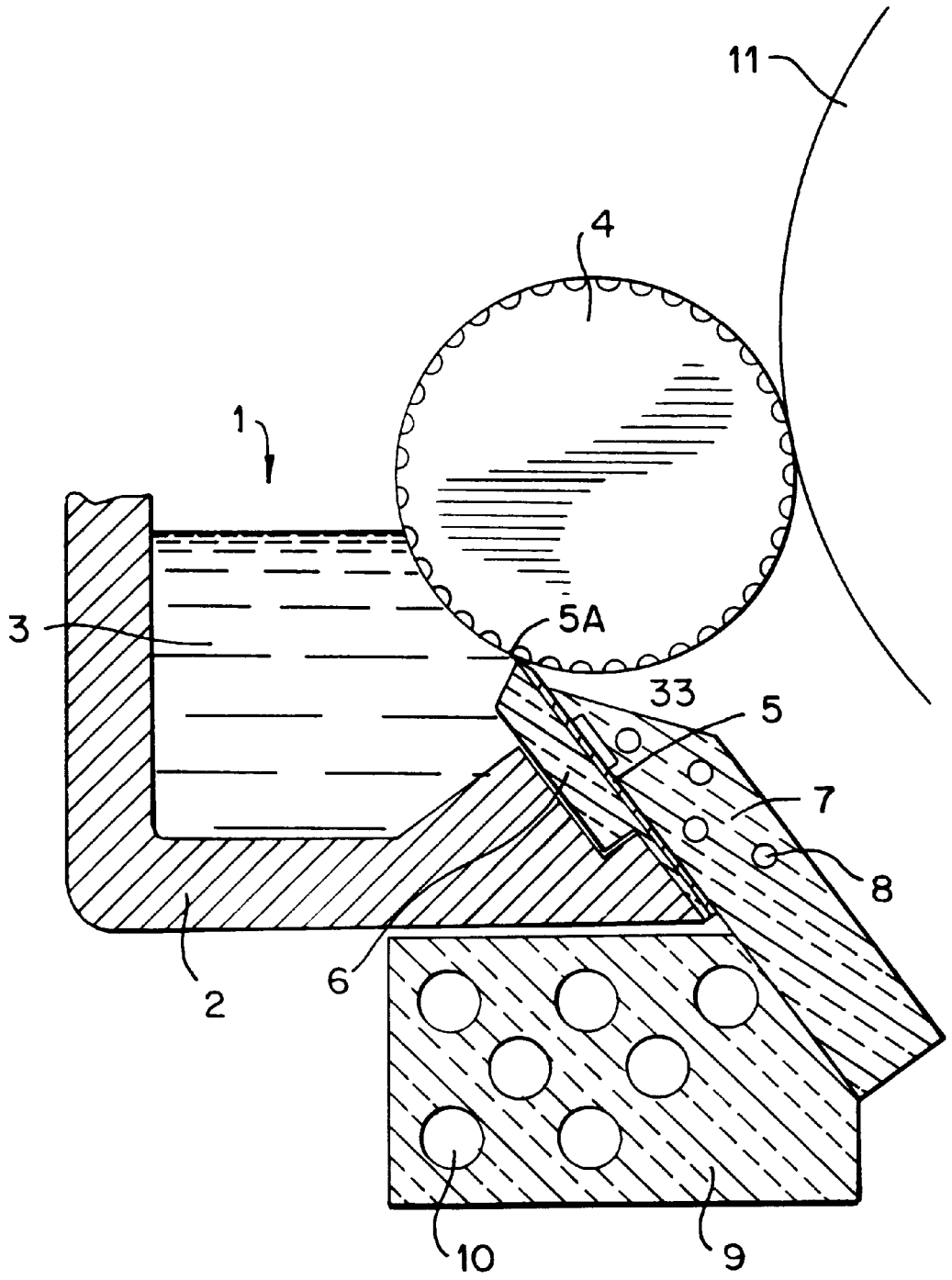
FIG. 1 is a cross-section of an inking device with an ink duct pursuant to the present invention.

As is shown in FIG. 1, the inventive inking device 1 has an ink duct 2, which is filled with printing ink 3. The inking device 1 is a short inker (anilox inking unit). The printing ink 3 is transferred to a structured roller, i.e., an ink transfer roller or a cup roller 4. Excess printing ink 3 is removed from the cup roller 4 by a blade 5. Instead of the blade 5, another type of blade device can be provided; for example, the blade device can be a chamber blade (cf. FIG. 4). During the ink-removal process, frictional heat develops between the cup roller 4 and the blade 5 on the upper edge 5A of the blade 5. This heat is dissipated via an insulation plate 6. The insulation plate 6 is set into the wall of the ink duct 2 and borders substantially the entire area of the blade 5, relative to the printing ink 3, so that the printing ink 3, for the most part, does not come into contact with the blade 5. The insulation plate 6 is preferably made of a hard material, e.g., a ceramic material, to ensure sufficient mechanical strength for the blade 5 to be clamped securely between the insulation plate 6 and a heat conducting or dissipation plate 7 on the opposite longitudinal side of the blade 5. The heat dissipation plate 7 is made of a material with high heat conductivity. The heat dissipation plate 7 is preferably mechanically connected to the blade 5, for example, by screw connections.

The insulation plate 6 and the heat dissipation plate 7 can be provided alternatively to or in conjunction with each other.

To further increase heat conductivity, it is possible, especially when the contact pressure between the blade 5 and the heat dissipation plate 7 is not sufficient, to introduce a heat-conducting liquid, preferably an elastic heat-conducting means 33, e.g., silicone, between the blade 5 and the heat dissipation plate 7. In addition, there can be bore holes 8 or cooling coils in the heat dissipation plate 7 as well as in the insulation plate 6, through which a coolant flows for the purpose of moderating the temperature of the blade 5. The bore holes 8 or the cooling coils can also be used to heat the printing ink in the ink duct 2, the blade 5, the insulation plate 6 and the heat dissipation plate 7. This can be useful, for example, when the printing ink 3, at the beginning of the printing process, has not yet reached the temperature to be established during the printing process. To shorten the proofing phase, it can be desirable to heat all parts of the inking device 1.

In addition, there is a cooling device 9 that extends at least below the ink duct 2. The cooling device 9 can also be equipped with bores 10 or cooling coils, through which a coolant or temperature-moderating medium flows. In the embodiment shown, the cooling device 9 borders the heat dissipation plate 7, so that heat extracted from the blade 5 via the heat dissipation plate 7 can also be dissipated through the cooling device 9. This prevents the blade 5 from becoming excessively heated by the frictional heat created during contact with the mantle surface of the cup roller 4, and ensures that the printing ink 3 always has the same temperature. The printing ink 3 is transferred via the cup roller 4 to an ink application roller 11 and makes its way from the latter to a form cylinder (not shown). However, the inking device 1 can also have, in addition to the cup roller 4 and the ink application roller 11, other rollers (not shown).

Figure 2:
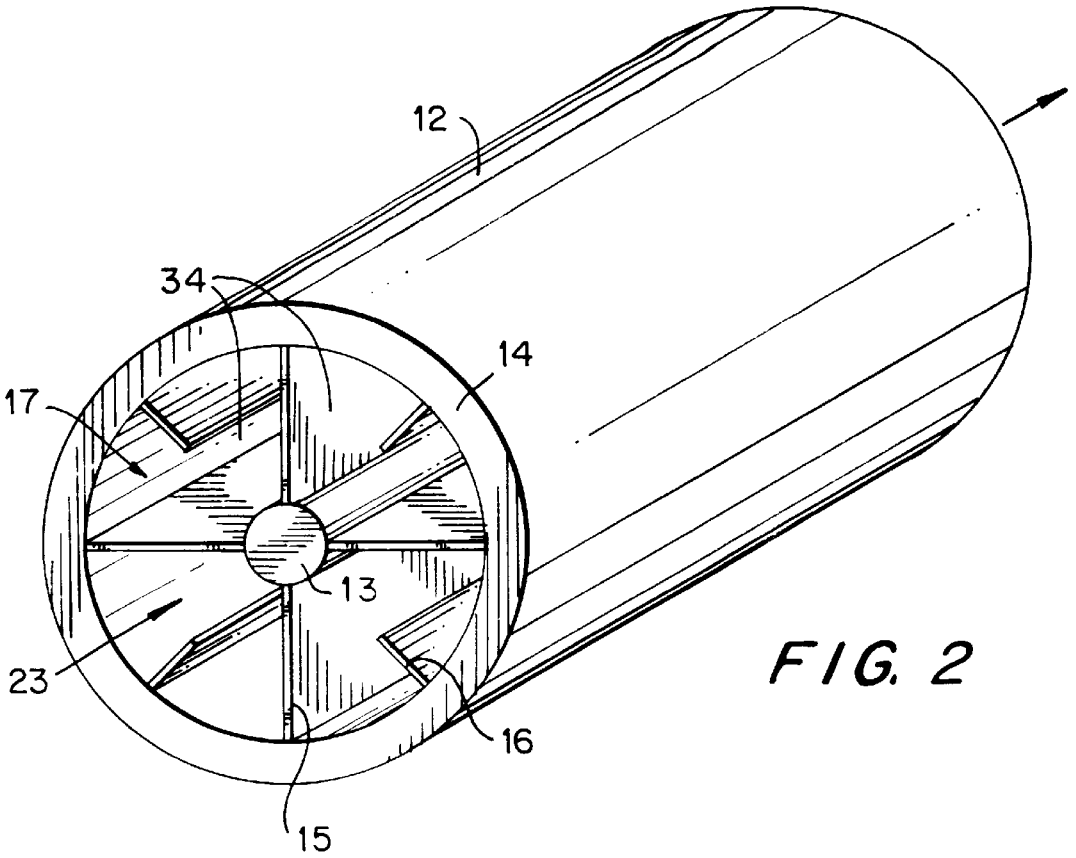
FIG. 2 is a perspective view of a roller equipped with a cooling device.

The rollers of the inking device 1, i.e., the cup roller 4, the ink application roller 11 or other rollers, can also be equipped with cooling devices to achieve, in conjunction with the cooling measures taken on the blade 5, efficient cooling and temperature-moderation of the printing ink 3. For example, FIG. 2 shows an inking device roller 12 that is substantially hollow in its interior. In its interior, the roller 12 has a massive tube 13 that serves as a rotational axis and is connected to a mantle body 14 by spokes 15. By means of the spokes 15, cavities 34 are formed in the interior of the inking device roller 12. The spokes 15 are embodied as plates that extend between the tube 13 and the mantle body 14 over the entire length of the inking device roller 12. Furthermore, ribs 16 extend from the mantle body 14 into the interior of the inking device roller 12. The spokes 15 and the ribs 16 serve to permit optimal heat transfer when a temperature-moderating medium, e.g., cold air, expanding pressurized air, or another cold gas, enters the inking device roller 12 laterally through an end face 17 (FIG. 3) and exits the inking device roller 12 on the other side through openings in the other end face 18. The inking device roller 12 is mounted in side walls 19, 20 via bearing journals 21, 22. The bearing journals 21, 22 are connected to the tube 13. Through openings (not shown here) in the side wall 19, a temperature-moderating medium, e.g., cooling air, passes via a supply tube 23 and enters the interior of the inking device roller 12 through the openings in the end face 17. The medium absorbs heat emitted by the spokes 15 and the ribs 16 and exits the inking device roller 12 through openings in the end face 18. The ribs 16 can also be embodied in a meandering or helical manner, so that the cooling air travels a long distance in the inking device roller 12 and heat exchange is optimized. The measures described in reference to the inking device roller 12 can also be implemented in other rollers and cylinders. The form cylinder or rubber-blanket cylinder of the printing machine can also be cooled by air or another gas.

Figure 3:
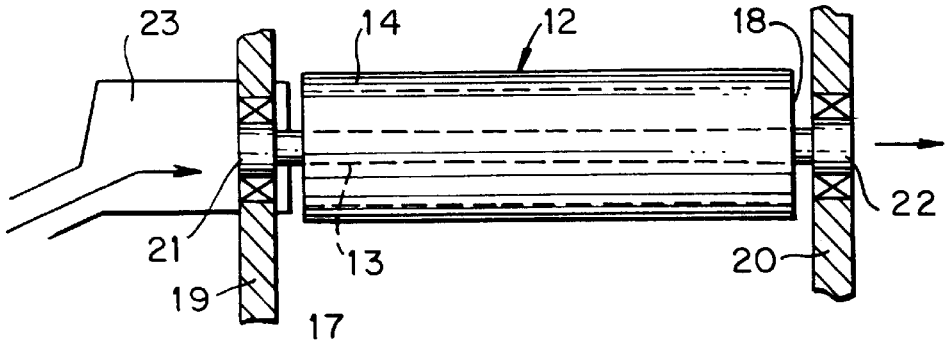
FIG. 3 is a longitudinal section through the interior of the roller in FIG. 2.

If the interior of the inking device roller 12, e.g., the cup roller 4 embodied as the inking roller device 12 in FIG. 3, is to be heated, a warm medium can be introduced into the interior of the inking device roller 12. Further, compressed air, e.g., expanding pressurized air, is also suitable for being conducted through the interior of the inking device roller 12. To conduct these gases, it is not necessary to seal the supply tube 23 at the exit area or the end face 17 in the inlet area of the gas so that all leakage is avoided, as would be necessary were a cooling fluid or a temperature-moderating fluid used. Rather, slight losses are acceptable when the gas from the output of the supply tube 23 enters the face-side opening in the end face 17 of the inking device roller 12. In addition, it is possible to provide chamber systems inside the inking device roller 12, which chamber systems conduct the gas through the inking device roller 12 in such a way that an even temperature distribution is attained over the entire width and circumference of the mantle body 14. These chambers and the ribs 16 can be embodied in a meandering fashion.

Figure 4:
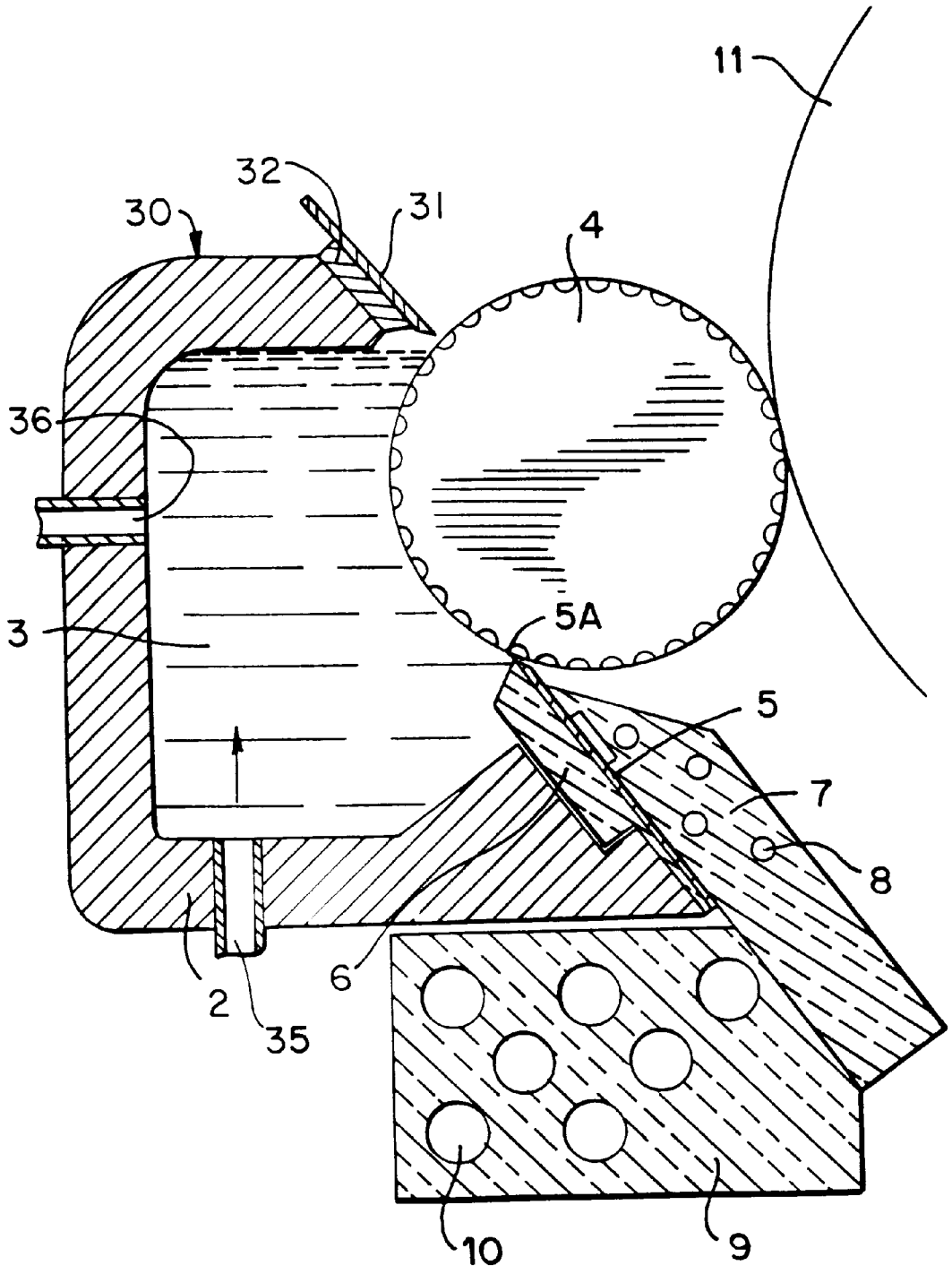
FIG. 4 is a cross-section of an inking device with an ink chamber.

Another embodiment of the invention is shown in FIG. 4, in which the inking device 1 has a closed ink chamber 30. The closed ink chamber 30 is filled with the printing ink 3. The printing ink 3 can preferably be supplied via an ink supply 35 and discharged via an ink discharge 36. A blade 31 acts as a closing blade or sealing blade. An insulation plate 32 is provided between the wall of the ink chamber 30 and the closing blade 31.

The invention provides an inking device 1 in a printing machine with an ink body 2 filled with printing ink 3 and with a blade 5. The blade 5 can also be a chamber blade, for example. For temperature moderation, an insulation plate 6 or a plate that dissipates heat (heat dissipation plate 7), by means of which the temperature of the blade 5 can be adjusted, is arranged on the blade 5. The frictional heat created by friction between the upper edge 5A of the blade 5 and the surface of the cup roller 4 does not penetrate into the ink duct 2. Heating of the printing ink 3 is thus avoided.

The temperature-moderating device for the inking device 1 can advantageously be used in connection with temperature-moderating devices arranged on the inking device rollers 12, i.e., the cup roller 4 or the ink application roller 11.

The invention is not limited by the embodiments described above which are presented as examples only but can be modified in various ways within the scope of protection defined by the appended patent claims.

We claim:

1. An inking device for a printing machine, comprising:

an ink reservoir;

a structured ink transfer roller;

a blade operatively mounted on the ink reservoir and arranged so as to wipe ink from the structured ink transfer roller; and an insulation plate mounted to a longitudinal side of the blade facing the reservoir so that printing ink in the reservoir is thermally insulated from the blade.

2. An inking device as defined in claim 1, wherein the ink reservoir is an ink duct.

3. An inking device as defined in claim 1, wherein the ink reservoir is an ink chamber.

4. An inking device as defined in claim 1, and further comprising a temperature moderating device arranged on the blade.

5. An inking device as defined in claim 1, wherein the temperature-moderating device is operative to moderate temperature of the blade.

6. An inking device as defined in claim 5, wherein the temperature-moderating device includes a heat dissipation plate arranged on a longitudinal side of the blade facing away from the ink so that heat can be dissipated away from the blade.

7. An inking device as defined in claim 6, and further comprising a heat-conducting medium arranged between the blade and the heat dissipation plate.

8. An inking device as defined in claim 7, wherein the heat-conducting medium is an elastic heat conducting medium.

9. An inking device as defined in claim 8, wherein the heat-conducting medium is silicone.

10. An inking device as defined in claim 6, and further comprising a cooling device arranged on the ink reservoir.

11. An inking device as defined in claim 10, wherein the cooling device is arranged so as to border the heat dissipation plate.

12. An inking device as defined in claim 10, wherein at least one of the heat dissipation plate and the cooling device has passages through which a temperature-moderating medium is passable.

13. An inking device as defined in claim 1, wherein the ink transfer roller has cavities in its interior so that the roller can be temperature-moderated by a gaseous temperature-moderating medium introducible into the cavities.

14. An inking device as defined in claim 13, wherein the roller has a mantel, a central tube and spokes that extend between the mantel and the central tube.

15. An inking device as defined in claim 14, wherein the roller has end faces configured so that the temperature-moderating medium can enter and exit the roller.

16. An inking device as defined in claim 13, wherein the roller has a mantel, a central tube and ribs that extend from the mantel toward the central tube.

17. An inking device as defined in claim 14, wherein the roller additionally has ribs that extend from the mantel toward the central tube.

* * * * *